US006732877B2

(12) United States Patent
Wu et al.

(10) Patent No.: US 6,732,877 B2
(45) Date of Patent: May 11, 2004

(54) AIR VENT PLUG ARRANGEMENT HAVING A MOUNTING RING, A PLUG BODY, AND A PLUG CAP FOR SECURING THE PLUG BODY TO THE MOUNTING RING

(75) Inventors: Tzong-Ming Wu, Taipei (TW); Wu-Chen Su, Kaohsiung Hsien (TW); Sheng-Fu Tsai, Feng-Shan (TW)

(73) Assignee: Industrial Technology Research Institute, Hsinchu (TW)

( * ) Notice: Subject to any disclaimer, the term of this patent is extended or adjusted under 35 U.S.C. 154(b) by 160 days.

(21) Appl. No.: 09/989,383

(22) Filed: Nov. 21, 2001

(65) Prior Publication Data

US 2003/0047562 A1 Mar. 13, 2003

(30) Foreign Application Priority Data

Sep. 12, 2001 (TW) ..... 90215658 U

(51) Int. Cl.[7] ..... B65D 41/36

(52) U.S. Cl. ..... 220/300; 220/367.1; 220/371; 206/710

(58) Field of Search ..... 220/367.1, 371, 220/300, 293; 215/308, 364; 206/710–712, 832, 454; 414/292

(56) References Cited

U.S. PATENT DOCUMENTS 2,650,673 A * 9/1953 Bering et al. ..... 220/371
4,765,499 A * 8/1988 von Reis et al. ..... 215/261
5,971,203 A * 10/1999 Bae ..... 220/746

* cited by examiner

*Primary Examiner*—Robin A. Hylton
(74) *Attorney, Agent, or Firm*—Rabin & Berdo, P.C.

(57) ABSTRACT

An air vent plug for clean container is disclosed, which includes a mounting ring, a plug body, and a plug cap, the plug cap having an inner ring fitted into the plug body, retaining notches forced into engagement with respective hooks of the plug body, an outer ring fitted over the outer surface of the mounting ring, and top hooks extended from the outer ring and hooked on respective pegs at the outer surface of the mounting ring. An O-ring is mounted outside the plug body and stopped between a collar of the plug body and a bottom edge of the mounting ring for sealing. A filter is mounted inside the plug body to prevent contamination from air passing through the plug body and the air vent of the clean container.

13 Claims, 4 Drawing Sheets

AIR VENT PLUG ARRANGEMENT HAVING A MOUNTING RING, A PLUG BODY, AND A PLUG CAP FOR SECURING THE PLUG BODY TO THE MOUNTING RING

BACKGROUND OF THE INVENTION

1. Field of the Invention

The present invention relates to an air vent plug arrangement for clean container and, more particularly, to an air vent plug arrangement for use in a clean container, for example, a wafer carrier, reticle container, or the like to keep the inside air pressure of the clean container in balance with the atmospheric pressure, and allow the clean container to breathe through the filtered air vent, minimizing the amount of unfiltered air that leaks through the door seal.

2. Description of Related Art

A regular wafer carrier or reticle container is adapted to transport wafers or reticles between a stocker and a load port or opener. A conventional clean container for this purpose has an access opening and a door panel adapted to close the access opening. It is not easy to disconnect the door panel from the access opening because of a sealer between them. When directly opening the door panel, a flow of air may rush into the inside of the clean container, causing storage wafers or reticles to be contaminated with particles or pollutant carried in the flow of air. There is known another design of a clean container, which comprises a blocking block adapted to seal the air vent in the lining of the door panel thereof, and a linkage controlled by a latch key to move the blocking block from the air vent for circulation of air to keep the inside air pressure and the outside air pressure of the clean container in balance. This design still has numerous drawbacks. Because the air vent is provided in the lining of the door panel, it is not easy to dismount the internal structure of the door panel during a repair work. If a filter is used, the replacement of the filter is difficult to achieve. Due to limited space, the design of the position and size of the air vent is restricted. Also, particles caused by the abrasion of the mechanisms will reduce the airflow capability and life of the filter.

Therefore, it is desirable to provide an air vent plug arrangement for a clean container that eliminates the aforesaid drawbacks.

SUMMARY OF THE INVENTION

It is the main object of the present invention to provide an air vent plug arrangement for clean container, which is easy to mount and dismount. It is another object of the present invention to provide an air vent plug arrangement for clean container, which keeps the inside air pressure and outside air pressure of the clean container in balance rapidly, and allows the clean container to breathe through the filtered vent, minimizing the amount of unfiltered air that leak through the door seal.

To achieve these and other objects of the present invention and according to one aspect of the present invention, the air vent plug for clean container comprises an air ventilation plug arrangement installed in an air vent of a clean container, comprises a mounting ring, a plug body, and a plug cap. The mounting ring is fixedly fastened to the air vent of a clean container, the mounting ring comprising an inner surface, an outer surface, a bottom side edge, and at least two pegs symmetrically provided at the outer surface. The plug body is shaped like a cap, comprising a top sidewall, an annular peripheral sidewall, a collar extended outside around the annular peripheral sidewall on the middle and dividing the annular peripheral sidewall into an upper part insertable into the inside of the inner surface of the mounting ring, and a lower part, and at least two hooks symmetrically axially extended from the lower part. The plug cap is adapted to secure the plug body to the mounting ring, comprising a bottom sidewall, an outer ring upwardly extended from an outer diameter of the bottom sidewall and fitted over the outer surface of the mounting ring, an inner ring upwardly extended from an inner diameter of the bottom sidewall and fitted into the annular peripheral sidewall of the plug body, at least two top hooks respectively extended from the outer ring and hooked on the at least two pegs of the mounting ring, a top sidewall integral with a top side of the inner ring of the plug cap, and at least two retaining notches disposed in the inner ring adjacent to the bottom sidewall and forced into engagement with the at least two hooks of the plug body respectively. During installation, the inner ring of the plug cap is inserted into the plug body to force the respective retaining notches into engagement with the respective hooks of the plug body, and then the upper part of the plug body is inserted into the mounting ring, and then the plug cap is rotated through an angle to force the hooks of the plug cap into engagement with respective pegs of the mounting ring.

According to another aspect of the present invention, the air vent can be formed in the bottom panel, top panel, side panel, or door panel of the clean container. Preferably, the air vent is provided at a broad area adjacent to the access opening of the clean container, so that the diameter of the air vents can be made as big as possible for enabling the inside air pressure and the outside air pressure to be rapidly in balance.

According to still another aspect of the present invention, an O-ring is mounted outside the upper part of the annular peripheral sidewall of the plug body and stopped between a collar of the plug body and the bottom edge of the mounting ring for sealing, and a filter is mounted inside the plug body to prevent airborne particles from entering the clean container during air pressure equalization.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
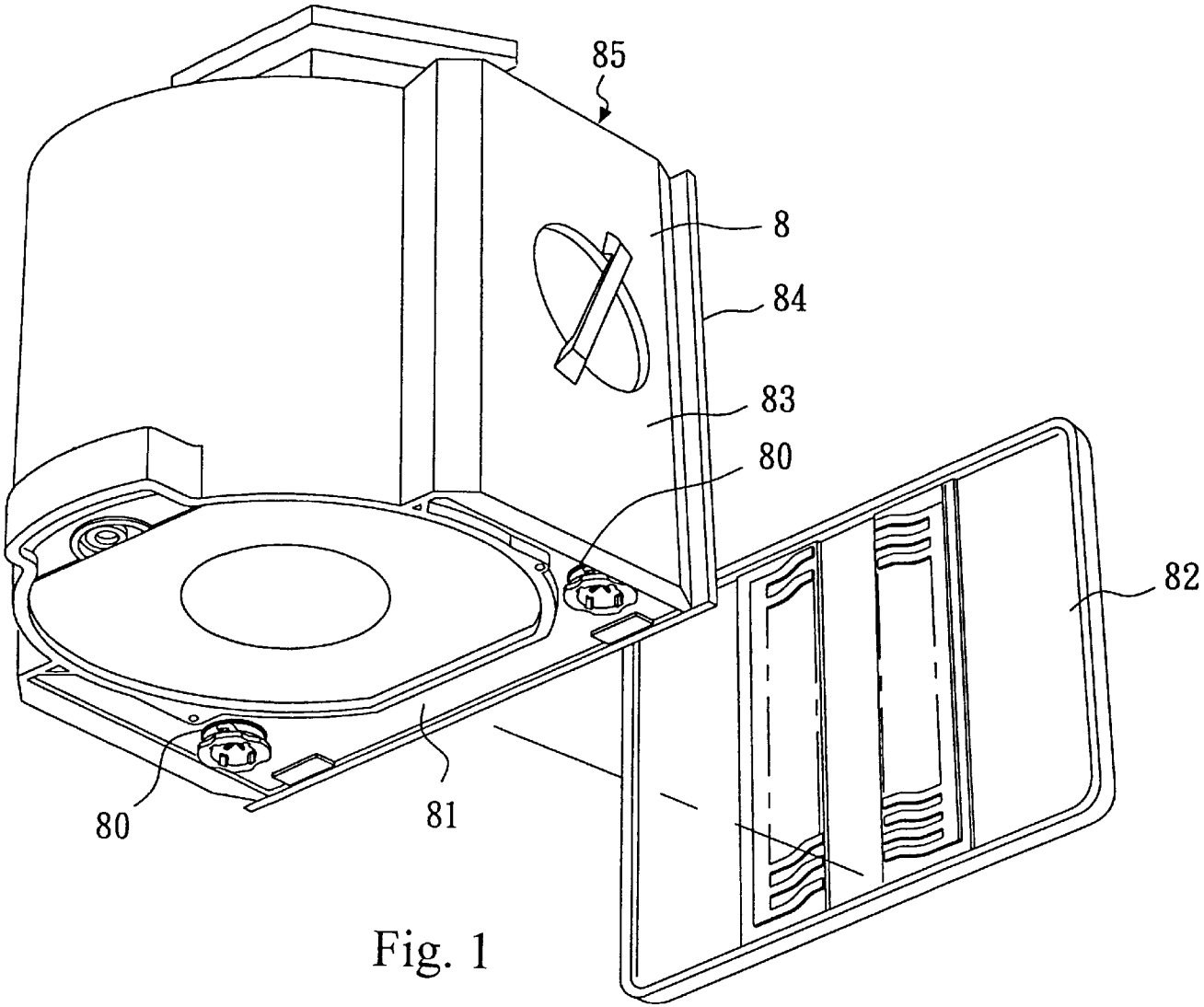
FIG. 1 depicts a perspective view of the present invention showing the air vent plug arrangement installed in a wafer carrier.

With reference to FIG. 1, a wafer carrier 8 is shown having an access opening 84, a door panel 82 adapted to close the access opening 84, and two air vents 80 in the bottom panel 81 thereof. According to this embodiment, the air vents 80 are bilaterally disposed in the bottom panel 81 adjacent to the access opening 84. Because the bottom panel 81 has a broad area available for making air holes, big air vents can be made in the bottom panel 81 for enabling the inside air pressure and the outside air pressure to be rapidly kept in balance, and keeping the inflow of air stable and clean. Of course, the air vents can be selectively made in the top panel 85, the side panel 83, the door panel 82, or any other broad area near the access opening 84 of the wafer carrier 8.

Figure 2:
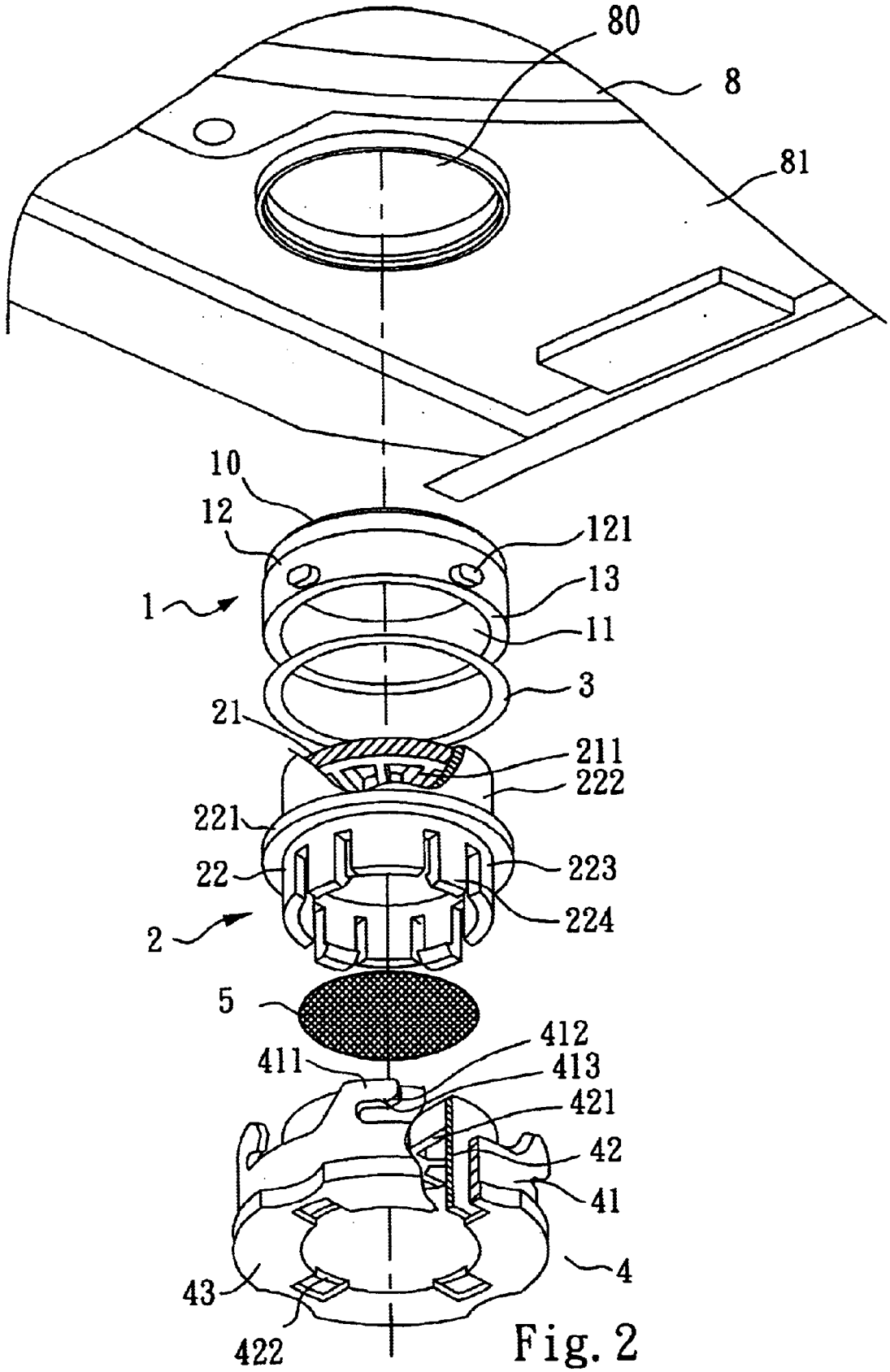
FIG. 2 is an exploded view of the air vent plug arrangement according to the present invention.

Referring to FIG. 2, an air vent plug arrangement is to be installed in the air vent 80, comprised of a mounting ring 1, a plug body 2, a plug cap 4, and a filter 5. The mounting ring 1 has a top side edge 10 fixedly fastened to the air vent 80 of the wafer carrier 8 by, for example, an ultrasonic welding apparatus. Alternatively, the mounting ring 1 can be formed integral with the bottom panel 81 of the wafer carrier 8 around the air vent 80. The mounting ring 1 has an inner surface 11, an outer surface 12, a bottom side edge 13, and a plurality of, for example, four pegs 121 equiangularly spaced around the outer surface 12.

The plug body 2 is shaped like a cap having a top wall 21, and an annular peripheral sidewall 22. The top wall 21 has a slotted partition wall portion 211. The plug body 2 further comprises a collar 221 extended outside around the annular peripheral sidewall 22 on the middle, dividing the annular peripheral sidewall 22 into an upper part 222 and a lower part 223. The upper part 222 of the peripheral sidewall 22 of the plug body 2 fits the inner diameter of the inner surface 11 of the mounting ring 1. The lower part 223 of the peripheral sidewall 22 of the plug body 2 has four symmetrical spring hooks 224 extended in an axial direction.

The plug cap 4 comprises a bottom wall 43 an outer ring 41, and an inner ring 42. The outer ring 41 and the inner ring 42 are respectively upwardly extended from the outer and inner diameters of the bottom wall 43. The outer ring 41 fits over the outer surface 12 of the mounting ring 1, and has four L-shaped top hooks 411 adapted to hook the pegs 121 of the mounting ring 1. The inner ring 42 fits the inner diameter of the annular peripheral sidewall 22 of the plug body 2. The plug cap 4 further comprises a slotted partition wall portion 421 integral with the top side of the inner ring 42, and four retaining notches 422 in the inner ring 42 adjacent to the bottom wall 43 for engagement with the spring hooks 224 of the plug body 2 respectively.

Figure 3:
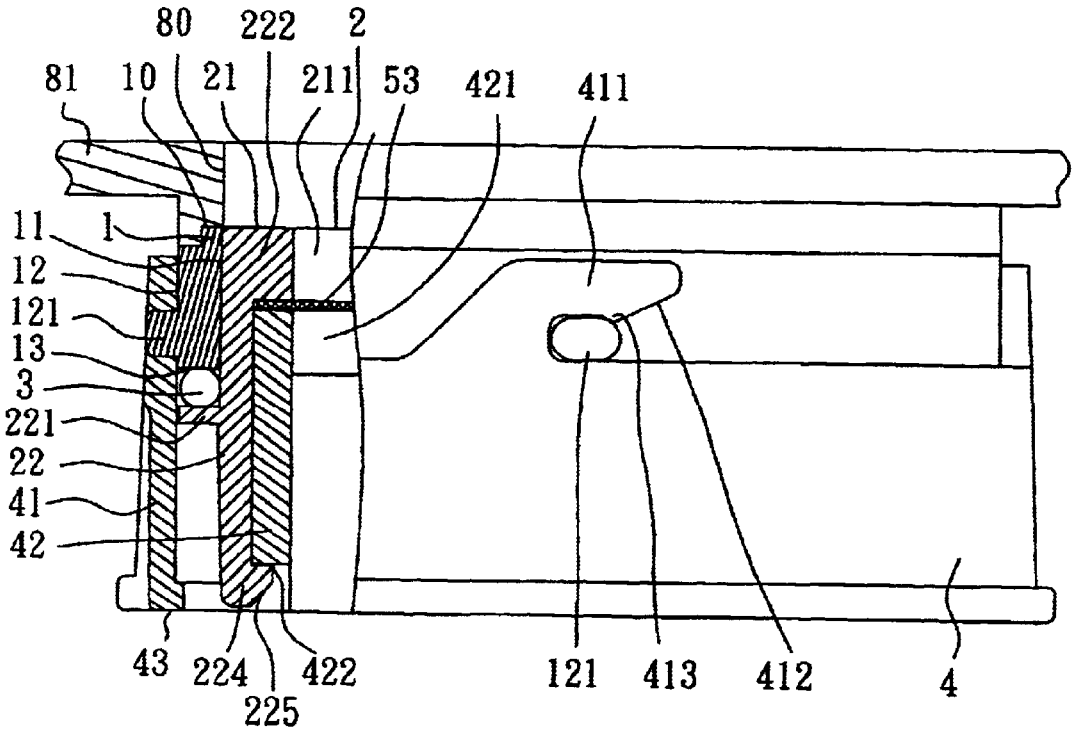
FIG. 3 is a side view partially in section of the air vent plug arrangement according to the present invention.

Referring to FIG. 3 and FIG. 2 again, during installation, the filter 5 is inserted into the inside of the upper part 222 of the peripheral sidewall 22 of the plug body 2 and closely attached to the slotted partition wall portion 211, and then the inner ring 42 of the plug cap 4 is inserted into the inside of the peripheral sidewall 22 of the plug body 2 to force the retaining notches 422 of the plug cap 4 into engagement with the spring hooks 224 of the plug body 2, keeping the filter 5 positively retained in position between the slotted partition wall portion 211 of the plug body 2 and the slotted partition wall portion 421 of the plug cap 4 for preventing particles or contamination from air passing through the air vent 80, and then the upper part 222 of the peripheral sidewall 22 of the plug body 2 is inserted into the inside of the inner surface 11 of the mounting ring 1 and rotated through an angle to force the top hooks 411 of the plug cap 4 into engagement with the pegs 121 of the mounting ring 1.

When dismounting the air hole plug arrangement, rotate the plug cap 4 in the reversed direction to disengage the top hooks 411 of the plug cap 4 from the pegs 121, enabling the plug cap 4, the plug body 2, and the filter 5 to be conveniently removed from the mounting ring 1.

Referring to FIGS. 2 and 3 again, an O-ring 3 is mounted outside the upper part 222 of the peripheral sidewall 22 of the plug body 2 and supported on the collar 221. When the upper part 222 of the peripheral sidewall 22 of the plug body 2 fastened to the inside of the inner surface 11 of the mounting ring 1, the O-ring 3 is squeezed by the bottom side edge 13 of the mounting ring 1 and the collar 221 of the plug body 2 to seal the gap. The top hooks 411 of the plug cap 4 each have a beveled guide face 412 at the front side adapted to guide the respective top hook 411 into engagement with the corresponding peg 121, and a protruded portion 413 adapted to secure the corresponding peg 121 in the engaged position. The spring hooks 224 of the plug body 2 each have a beveled guide face 225 adapted to guide the inner ring 42 of the plug cap 4 into the inside of the peripheral sidewall 22 of the plug body 2. The pegs 121 of the mounting ring 1 can be made having a circular, rhombic, or honeycomb shape, or any of a variety of other shapes. Preferably, the pegs 121 have an oblong shape. The ends of the oblong pegs 121 are smoothly arched for guiding the corresponding top hook 411 of the plug cap 4 into position. When engaged, the upper long side of the oblong peg 121 is closely attached to the corresponding top hook 411, producing a friction resistance to prevent the corresponding top hook 411 from displacement.

Figure 4:
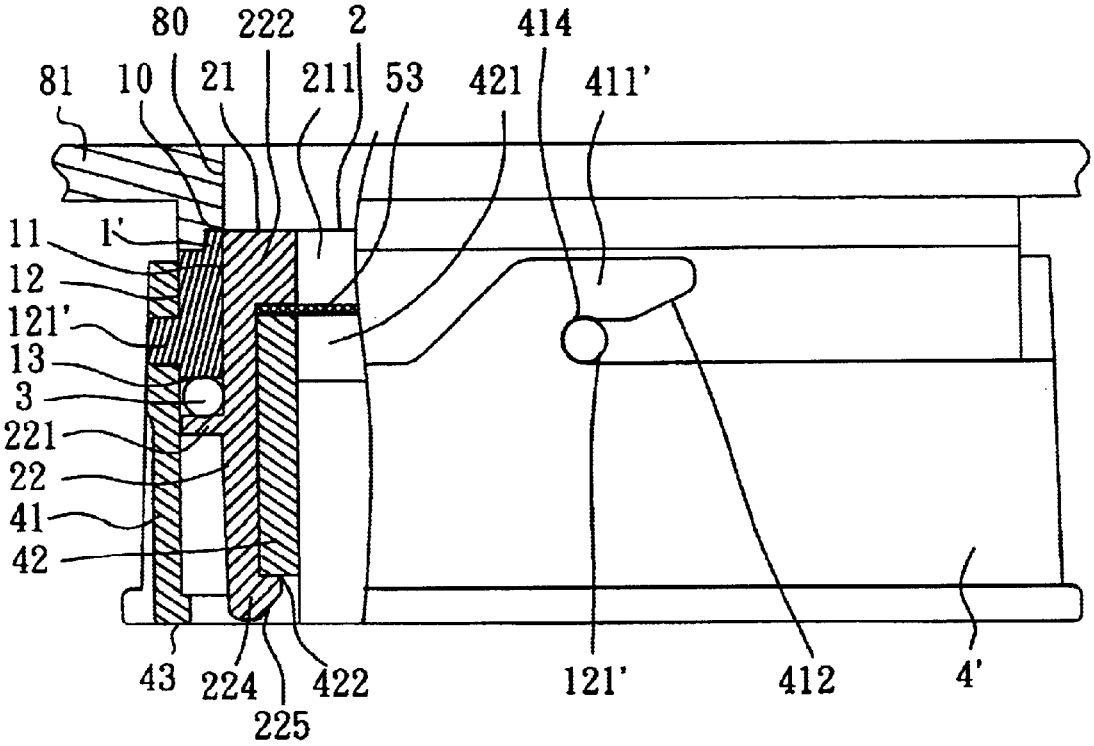
FIG. 4 is a side view partially in section of an alternate form of the air vent plug arrangement according to the present invention.

FIG. 4 shows an alternate form of the present invention. According to this alternate form, the pegs 121' of the mounting ring 1' are circular pegs, and each top hook 411' of the plug cap 4' defines a retaining notch 414 at an inner side adapted to receive the corresponding circular peg 121'. When the top hook 411' hooked on the corresponding circular peg 121', the corresponding circular peg 121' is automatically set in the retaining notch 414.

Although the present invention has been explained in relation to its preferred embodiment, it is to be understood that many other possible modifications and variations can be made without departing from the spirit and scope of the invention as hereinafter claimed.

What is claimed is:

1. An air vent plug arrangement installed in an air vent of a clean container, comprising:

a mounting ring fixedly fastened to an air hole of said clean container, said mounting ring comprising an inner surface, an outer surface, a bottom side edge, and at least two pegs symmetrically provided at the outer surface of said mounting ring;

a plug body comprising a top wall, an annular peripheral sidewall, a collar disposed outside and around said annular peripheral sidewall and dividing said annular peripheral sidewall into an upper part insertable into said mounting ring, and a lower part, and at least two hooks symmetrically axially extended from said lower part; and a plug cap adapted to secure said plug body to said mounting ring, said plug cap comprising a bottom wall, an outer ring upwardly extended from the bottom wall at an outer diameter thereof and fitted over the outer surface of said mounting ring, an inner ring upwardly extended from the bottom wall at an inner diameter thereof and being adapted to fit into said plug body, at least two top hooks respectively extended from the outer ring and being adapted to be hooked on said at least two pegs of said mounting ring, a top wall integral with a top side of the inner ring of said plug cap, and at least two retaining notches disposed in the inner ring of said plug cap adjacent to the bottom wall of said plug cap and being engageable with the at least two hooks of said plug body respectively.

2. The air vent plug arrangement as claimed in claim 1, further comprising an O-ring mounted outside the upper part of the annular peripheral sidewall of said plug body and being disposed between the collar of said plug body and the bottom side edge of said mounting ring.

3. The air vent plug arrangement as claimed in claim 1, further comprising a filter mounted inside said plug body and retained between the top wall of said plug body and the top wall of said plug cap.

4. The air vent plug arrangement as claimed in claim 1, wherein the hooks of said plug cap each have a front side and a beveled face at the front side.

5. The air vent plug arrangement as claimed in claim 1, wherein the hooks of said plug cap each have a front side and a protruded portion projected from the front side.

6. The air vent plug arrangement as claimed in claim 1, wherein the hooks of said plug cap each have a retaining notch disposed at a rear end of an inner side thereof.

7. The air vent plug arrangement as claimed in claim 1, wherein the pegs of said mounting ring are oblong pegs.

8. The air vent plug arrangement as claimed in claim 1, wherein the pegs of said mounting ring are circular pegs.

9. The air vent plug arrangement as claimed in claim 1, wherein the hooks of said plug body each have a front side and a beveled face at the front side.

10. The air vent plug arrangement as claimed in claim 1, wherein said mounting ring is fixedly fastened to the air vent of said clean container by ultrasonic welding.

11. The air vent plug arrangement as claimed in claim 1, wherein the air vent of said clean container is disposed in a bottom panel of said clean container.

12. The air vent plug arrangement as claimed in claim 1, wherein the top wall of said plug body has a slotted partition wall portion for the passing of air.

13. The air vent plug arrangement as claimed in claim 1, wherein the top wall of said plug cap has a slotted partition wall portion for the passing of air.

* * * * *